US005611914A

United States Patent [19]

Prince et al.

[11] Patent Number: 5,611,914

[45] Date of Patent: Mar. 18, 1997

[54] METHOD FOR REMOVING SULFUR FROM A HYDROCARBON FEED

[75] Inventors: William R. Prince, Torrance; Robert L. Jacobson, Vallejo, both of Calif.

[73] Assignee: Chevron Chemical Company, San Ramon, Calif.

[21] Appl. No.: 289,536

[22] Filed: Aug. 12, 1994

[51] Int. Cl.[6] ..... C10G 45/06

[52] U.S. Cl. ..... 208/217; 208/95; 208/213; 208/60

[58] Field of Search ..... 208/91, 65, 660, 208/217, 213, 95

[56] References Cited

U.S. PATENT DOCUMENTS

| | | | |
|---|---|---|---|
| 4,446,005 | 5/1984 | Eberly, Jr. | 208/91 |
| 4,464,252 | 8/1984 | Eberly, Jr. | 208/243 |
| 4,592,829 | 6/1986 | Eberly, Jr. | 208/89 |
| 4,634,515 | 1/1987 | Bailey et al. | 208/91 |
| 5,043,057 | 8/1991 | Boyle | 208/64 |
| 5,106,484 | 4/1992 | Nadler et al. | 208/91 |
| 5,300,211 | 4/1994 | Russ et al. | 208/65 |
| 5,366,614 | 11/1994 | Russ et al. | 208/65 |

*Primary Examiner*—Helane Myers
*Attorney, Agent, or Firm*—Burns, Doane, Swecker and Mathis

[57] ABSTRACT

Provided is a method for removing residual sulfur from a hydrotreated naphtha feed. The process comprises contacting the naphtha feed with massive nickel catalyst in the presence of hydrogen. The contacting is generally accomplished in the temperature range of 300° F. to about 450° F. Such contacting has been found to achieve quite effective removal of sulfur, particularly thiophenes.

23 Claims, 1 Drawing Sheet

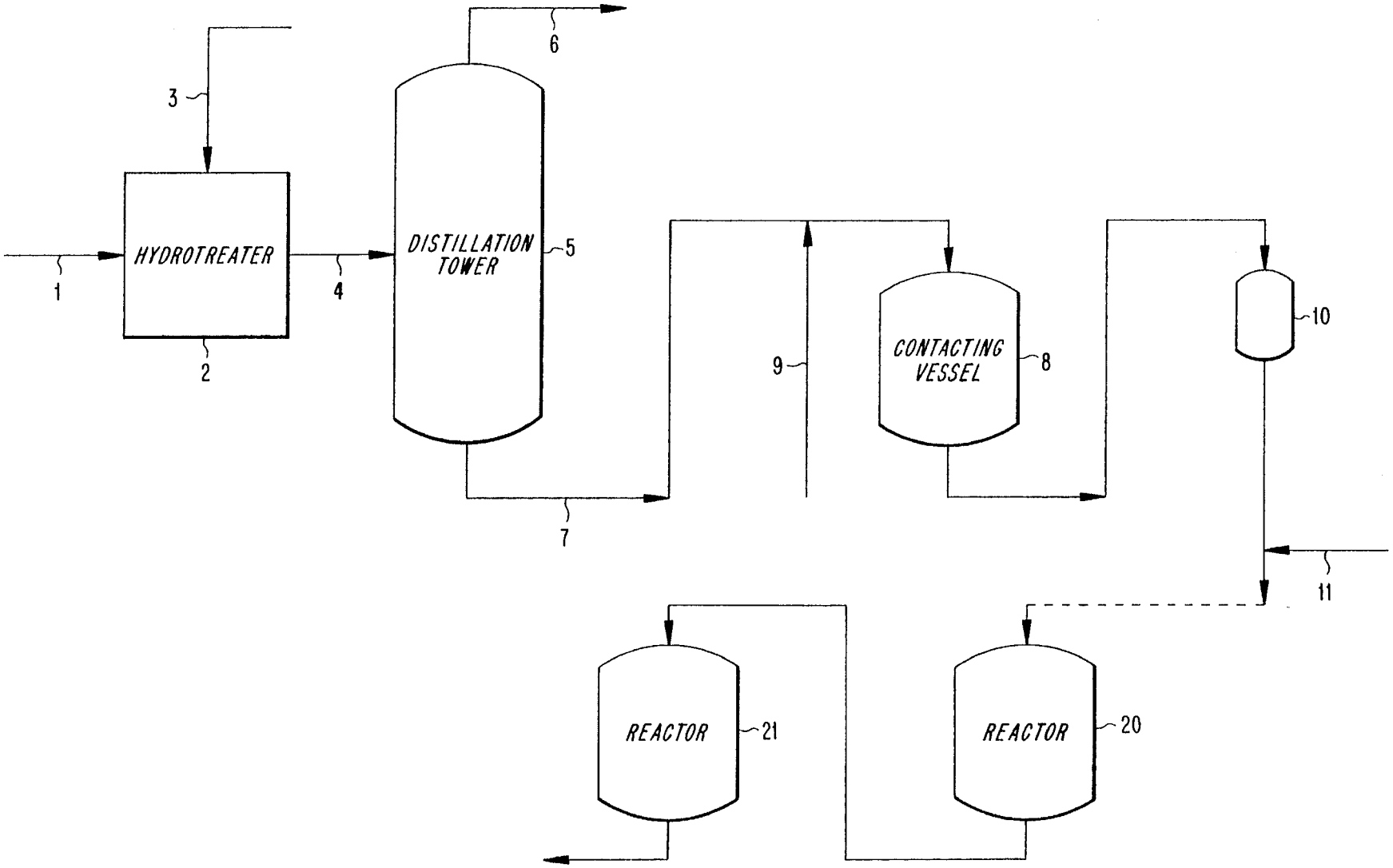
HYDROTREATER
DISTILLATION TOWER
CONTACTING VESSEL
REACTOR
REACTOR
1
2
3
4
5
6
7
8
9
10
11
20
21

METHOD FOR REMOVING SULFUR FROM A HYDROCARBON FEED

BACKGROUND OF THE INVENTION

The present invention relates to the removal of sulfur from a hydrocarbon feedstock. In another embodiment, the present invention relates to a reforming process using a highly sulfur sensitive catalyst.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds. The sulfur in aromatic sulfur-containing ring compounds will be herein referred to as "thiophene sulfur".

Conventionally, feeds with substantial amounts of sulfur, for example, those with more than 10 ppm sulfur, are hydrotreated with conventional hydrotreating catalysts under conventional conditions, thereby changing the form of most of the sulfur in the feed to hydrogen sulfide. Then, the hydrogen sulfide is removed by distillation, stripping or related techniques. Unfortunately, these techniques often leave some traces of sulfur in the feed, including thiophene sulfur, which is the most difficult type to convert.

Such hydrotreated naphtha feeds are frequently used as feeds for catalytic dehydrocyclization, also known as reforming. Catalytic reforming processes play an integral role in upgrading naphtha feedstocks to high octane gasoline blend stocks and for converting naphtha feedstocks into valuable chemicals such as benzene, toluene and xylenes. These processes have become more important in recent years because of the increase in demand for low-lead and unleaded gasolines. However, some of the catalysts used in reforming are extremely sulfur sensitive, particularly those that contain zeolitic components. It is generally recognized, therefore, that the sulfur content of the feedstock must be minimized to prevent poisoning of such reforming catalysts.

One conventional method for removing residual hydrogen sulfide and mercaptan sulfur is the use of sulfur sorbents. See, for example, U.S. Pat. Nos. 4,204,947 and 4,163,708, the contents of which are hereby incorporated by reference. The concentration of sulfur in this form can be reduced to considerably less than 1 ppm by using the appropriate sorbents and conditions, but it has been found to be difficult to remove sulfur to less than 0.1 ppm, or to remove residual thiophene sulfur. See, for example, U.S. Pat. No. 4,179,361 the contents of which is hereby incorporated by reference, and particularly Example 1 of that patent. Very low space velocities are required to remove thiophene sulfur, requiring large reaction vessels filled with sorbent. Even with these precautions, traces of thiophene sulfur still can be found.

See also U.S. Pat. No. 4,456,527, the contents of which is hereby incorporated by reference, disclosing a hydrocarbon conversion process having a very high selectivity for dehydrocyclization. In one aspect of the disclosed process, a hydrocarbon feed is subjected to hydrotreating, and then the hydrocarbon feed is passed through a sulfur removal system which reduces the sulfur concentration of the hydrocarbon feed to below 500 ppb (0.5 ppm). The resulting hydrocarbon feed is then reformed.

Various possible sulfur removal systems are disclosed for reducing the sulfur concentration of the hydrocarbon feed to below 500 ppb. The various systems mentioned include passing the hydrocarbon feed over a suitable metal or metal oxide, for example copper, on a suitable support, such as alumina or clay, at low temperatures in the range of 200° F. to 400° F. in the absence of hydrogen; or, passing a hydrocarbon feed, in the presence or absence of hydrogen, over a suitable metal or metal oxide, or combination thereof, on a suitable support at medium temperatures in the range of 400° F. to 800° F.; or, passing a hydrocarbon feed over a first reforming catalyst, followed by passing the effluent over a suitable metal or metal oxide on a suitable support at high temperatures in the range of 800° F. to 1000° F.; or passing a hydrocarbon feed over a suitable metal or metal oxide and a Group VIII metal on a suitable support at high temperatures in the range of 800° F. to 1000° F.

In U.S. Pat. No. 4,925,549 there is disclosed a process for removing sulfur to less than 0.1 ppm (100 ppb) in an attempt to protect reforming catalysts which are sulfur sensitive. This patent, the contents of which is hereby incorporated by reference, discloses a method which comprises first contacting a feedstock with hydrogen under mild reforming conditions in the presence of a less sulfur sensitive reforming catalyst. This carries out some reforming reactions and also converts trace sulfur compounds to hydrogen sulfide. The effluent from the first step is then contacted with a solid sulfur sorbent to remove the $H_2S$ and provide an effluent which contains less than 0.1 ppm sulfur. This low sulfur containing effluent can then be contacted with the highly selective reforming catalyst which is extremely sulfur sensitive.

U.S. Pat. No. 5,322,615 discloses a method for removing sulfur to ultra low levels. The process comprises contacting the hydrotreated naphtha feedstock with a first solid sulfur sorbent comprising a metal, e.g., nickel, on a support to thereby form a first effluent. The first effluent is then contacted with a sulfur conversion catalyst comprising a Group VIII metal in the presence of hydrogen, thereby forming a second effluent. The second effluent is then contacted with a second solid sulfur sorbent containing a Group IA or IIA metal, to thereby lower the sulfur content of the feedstock to less than 10 ppb, and to as low as 1 ppb or less.

U.S. Pat. No. 5,106,484 discloses a process for treating a hydrodesulfurized naphtha feed involving massive nickel and a metal oxide such as manganese oxide. The hydrodesulfurized naphtha is first passed over a massive nickel catalyst, and the resulting naphtha is then passed over a metal oxide such as manganese oxide. The purified naphtha is then passed over a reforming catalyst comprising a large pore zeolite and at least one Group VIII metal.

While the state of the art has therefore progressed to protecting reforming catalysts which are sulfur sensitive to a large extent, the processes are often complex and expensive. Attempts continue, therefore, to reduce the sulfur contained in hydrocarbon feeds so as to permit a longer useful life for zeolite catalysts, but in a more practical and simplified manner.

Accordingly, it is an object of the present invention to provide a novel process which can remove substantially all sulfur, including thiophene sulfur, from a reforming feedstream.

Another object of the present invention is to provide a process which can efficiently and effectively reduce the amount of sulfur in a hydrocarbon feedstream.

Another object of the present invention is to provide a sulfur removal process which is practical and simple in its approach to removing sulfur.

Another object of the present invention is to integrate such a practical and efficient sulfur removal system into a reforming process.

These and other objects of the present invention will become apparent upon a review of the following specification, the drawing and the claims appended hereto.

SUMMARY OF THE INVENTION

In accordance with the foregoing objectives, this invention provides a most effective method for removing residual sulfur from a hydrotreated naphtha feedstock. The process comprises contacting the naphtha feedstock with massive nickel catalyst in the presence of hydrogen. Preferably the contacting is accomplished in the temperature range of 300° F. to about 450° F., and more preferably in the range of from about 350° to 425° F. Such contacting has been found to achieve quite effective removal of sulfur, including thiophenes. For example, the sulfur levels in the naphtha are reduced to less than 26 ppb, and preferably less than 10 ppb, and most preferably less than 5 ppb. Reduction to such levels of sulfur renders further downstream processing of the feed prior to contact with a sulfur sensitive catalyst optional.

In a specific embodiment, there is provided a method of reforming a naphtha feedstock which comprises hydrotreating the naphtha, contacting the naphtha with massive nickel catalyst in the presence of hydrogen, and then forwarding the resulting feed to a reforming operation, preferably utilizing a sulfur sensitive catalyst. Optionally, prior to feeding the naphtha to the reforming operation, the naphtha feed resulting from the contacting step with the massive nickel is further contacted in the presence of hydrogen with a sulfur conversion catalyst comprising a Group VIII metal, and then the resulting effluent is contacted with a solid sulfur sorbent comprising a Group IA or IIA metal.

The present invention, therefore, provides one with a simple yet efficient method for removing sulfur from a naphtha feedstock, thereby permitting effective and efficient reforming of a sulfur containing naphtha feedstock while employing a highly sulfur sensitive reforming catalyst, such as a platinum containing L zeolite. This is achieved because, among other factors, the present invention is based upon the recognition that when the sulfur containing naphtha is contacted over massive nickel catalyst in the presence of hydrogen, a substantial reduction in the sulfur content is realized. This is particularly true when the contacting is conducted in the temperature range of from about 300° to about 450° F. The simplicity and effectiveness of the process permits one to avoid the traditional use of much more complex and costly sulfur removal techniques.

BRIEF DESCRIPTION OF THE DRAWING

The FIGURE of the Drawing schematically depicts a system for practicing a process of the present invention.

DETAILED DESCRIPTION OF THE PREFERRED EMBODIMENTS

A naphtha feedstock containing low molecular weight sulfur-containing impurities such as mercaptans, thiophene, and the like, is usually subjected to a preliminary hydrodesulfurization treatment. The treatment is conventional and well known, and employs conventional hydrotreating catalysts and conditions. Generally, the hydrotreating is conducted at a temperature between about 400° F. and 900° F., a pressure between 200 psig and 750 psig, a liquid hourly space velocity between 1 and 5, and a hydrogen circulation rate of 500 to 3000 scf/b. The effluent from this treatment is subjected to distillation-like processes to remove $H_2S$. The effluent from the distillation step will typically contain between 0.2 and 5 ppm sulfur, and between 0.1 and 2 ppm thiophene sulfur. These amounts of sulfur can poison selective sulfur sensitive reforming catalysts in a short period of time. Therefore, the process of the present invention for removing the sulfur is applied to the resulting hydrotreated naphtha stream to reduce the amount of sulfur to such low levels that extremely long run lifes of sulfur sensitive catalysts are achievable.

Referring to the FIGURE of the Drawing, a naphtha feed 1 is passed to a hydrotreater 2. Hydrogen is fed to the hydrotreater via line 3. The effluent from the hydrotreater is then passed via 4 to distillation tower 5, where $H_2S$ is removed off the top 6, and the hydrodesulfurized naphtha feed is recovered at 7.

The hydrotreated naphtha stream 7 is then passed to the massive nickel catalyst for contacting 8. Massive nickel catalyst is 20 wt % to 75 wt % finely dispersed metallic nickel, i.e., particles having a size in the range of about 75 to 500 Angstrom, supported on an inorganic support such as alumina or silica. There are several suitable commercial grades, such as Harshaw's D-4130 and Hul's H10125. The most preferred commercially available nickel catalyst for the practice of the present invention, is a massive nickel catalyst made by United Catalysts, Inc. called C28. The specifics relating to this sorbent are as follows:

| Chemical Composition | Wt % |
|---|---|
| Ni | 54.0 ± 4.0 |
| $SiO_2$ | 28.0 ± 3.0 |
| $Al_2O_3$ | 10.0 ± 1.0 |
| % Reduction, Minimum | 40 |
| Physical Properties | |
| Bulk Density, Lb/Cu Ft | 44.0 ± 2 |
| Surface Area, $M^2$/gm | 250–280 |
| Pore Volume, cc/gm | 0.50–0.55 |
| Crush Strength, Lb/mm (minimum Average) | 2.1 |
| Attrition, Wt % (ASTM) | <1 |

The size of the contacting vessel 8 can be designed to fit the particular needs of the process to be run. For example, the size can be designed to achieve a greater than 90% reduction in hydrotreated feed sulfur over a two year period. The size can also be specifically designed to provide a safeguard in case severe upstream hydrotreater upsets occur and/or sulfur levels reach 10 ppm in the feedstream. If desired, a sulfur analyzer can be employed prior to the contacting vessel so as to detect any unusual amounts of sulfur in the feedstream.

An important aspect of the present invention is that the contacting of the naphtha feed with the massive nickel must be conducted in the presence of hydrogen. In the FIGURE, hydrogen can be added via line 9. It has been found that the presence of hydrogen during the contacting with the massive nickel catalyst results in a much more effective removal of sulfur from the naphtha feed. This particularly includes the removal of difficult sulfur molecules such as thiophene sulfur. The removal of sulfur using this single step of contacting the naphtha with massive nickel catalyst in the presence of hydrogen is so effective that further downstream processing of the feed prior to the reformer reactors utilizing sulfur sensitive catalysts is generally not needed. The sulfur level in the resulting feed can be below 26 ppb, more preferably below 10 ppb and most preferably below 5 ppb.

The amount of hydrogen used in the contacting step involves low levels of hydrogen. The hydrogen is added in amounts below its maximum solubility in the naphtha feed, up to a molar ratio of hydrogen to hydrocarbon of about 1. Generally, the amount of hydrogen added is such that the molar ratio of hydrogen to hydrocarbon is in the range of about 0.5 to 2.0, with about 1.0 being preferred.

The temperature is also an important consideration in the massive nickel catalyst contacting step. The temperature is generally in the range of from about 300° F. to about 450° F., more preferably in the range of from about 350° F. to about 425° F., with the range of about 375°–400° F. being most preferred. It has been found that when the naphtha feed is contacted with the massive nickel catalyst in the presence of hydrogen, the effective sulfur removal is not realized at temperatures lower than the aforedescribed range, and at temperatures higher than the range, undesirable side effects such as cracking of the hydrocarbons can occur. Therefore, the temperature is generally maintained in the range of from about 300° F. to about 450° F.

The remaining conditions of space velocity and pressure generally range within conventional limits. The space velocity is preferably within the range of 1.0 to 10.0 LHSV, more preferably in the range about 1.0 to 6.0 LHSV, and most preferably about 4.0 LHSV. The pressure is sufficient to maintain a liquid phase, and in general is less than 300 psig, and more preferably is in the range of from about 100 to 200 psig.

Once the naphtha has been contacted with the massive nickel catalyst in the presence of hydrogen, the effluent can be passed onto reformer reactors. It is preferred, however, that if the downstream reforming catalyst is water sensitive, the naphtha first be passed through a fixed bed 10 of molecular sieve selected to remove traces of water, such as 4A molecular sieve. Generally, the operating conditions of 10 involve ambient temperature, about 250 psig pressure, and 2 to 10 LHSV. However, these parameters can vary greatly, as long as acceptable water removal is achieved. The water content is preferably reduced to below about 3 and more preferably about 1 wppm or less.

Once the naphtha has been dried by using the molecular sieve 10, additional hydrogen can be added to the naphtha feed via line 11. This hydrogen is generally recycle hydrogen. The naphtha can then be passed to the reformer reactors, or optionally further treated for sulfur removal to lower the amount of sulfur to 5 ppb or less by using reactors 20 and 21.

In a preferred embodiment, reactor 20 contains a sulfur conversion catalyst comprised of a Group VIII metal. The naphtha is contacted with the conversion catalyst in the presence of hydrogen, which hydrogen can be introduced, e.g., into the naphtha, at 11. The reaction in the reactor 20 converts any organic sulfur, including thiophenes, to hydrogen sulfide.

The conversion catalyst used to contact the first effluent comprises a Group VIII metal and, if desired, a promoter metal, supported on a refractory inorganic oxide metal. Suitable refractory inorganic oxide supports include alumina, silica, titania, magnesia, boria, and the like and combinations such as silica and alumina or naturally occurring oxide mixtures such as clays. The preferred Group VIII metal is platinum. Also, a promoter metal such as rhenium, tin, germanium, iridium, rhodium, or ruthenium, may be present. Preferably, the sulfur conversion catalyst of reactor 20 comprises platinum on an aluminum support.

The contacting in reactor 20 is carried out in the presence of hydrogen at a pressure and temperature adjusted to thermodynamically favor conversion of organic sulfur to $H_2S$ and limit undesirable hydrocracking by kinetic means. The pressures which may be used vary from 15 psig to 500 psig, and are preferably between about 50 psig to about 300 psig; the molar ratio of hydrogen to hydrocarbons preferably being from 0.5:1 to 10:1, more preferably from 1:1 to 6:1.

The sulfur conversion reaction occurs with acceptable speed and selectivity at a temperature ranging from about 250° C. to 475° C. Therefore, reactor 20 containing the conversion catalyst is preferably operated at a temperature ranging from between about 250° C. and 425° C.

When the operating temperature of the reactor containing the conversion catalyst is more than about 300° C., the sulfur conversion reaction speed is sufficient to accomplish the desired reactions. At higher temperatures, such as 400° C. or more, reforming reactions, particularly dehydrogenation of napthenes, begin to accompany the sulfur conversion. Such reforming reactions are endothermic and may result in a temperature drop of 10° to 50° C. as the stream passes through this reactor. When the operating temperature of this reactor is much higher than 400° C., an unnecessarily large amount of reforming takes place which is accompanied by hydrocracking and coking. In order to minimize the undesirable side reactions, the reactor temperature should be not more than about 475° C., or preferably 425° C. The liquid hourly space velocity of the hydrocarbons in this contacting step with the sulfur conversion catalyst is preferably between 1 and 20, and is preferably from about 2 to 10.

Catalysts have varying sensitivities to sulfur in a feedstream. Some catalysts are less sensitive and do not show a substantially reduced activity if the sulfur level is kept below about 1 ppm. When the catalysts are deactivated by sulfur and coke buildup they can normally be regenerated by burning off the sulfur and coke deposits. Preferably, the sulfur conversion catalyst used in reactor 20 is of this type.

The effluent from the conversion step in reactor 20 is then preferably contacted in reactor 21 with a solid sulfur sorbent containing a Group IA and IIA metal. The sorber 21 is operated at moderate conditions comparable to those used in reactor 20. Generally, contact with this sulfur sorber reduces the amount of sulfur in the feedstream to as low as 1 ppb or even less.

Preferred supports for the solid sulfur sorbent in sorber reactor 21 include alumina, silica, titania, zirconia, boria, and the like, and mixtures thereof. Clays can also be used as supports. Particular clays of interest include the fibrous magnesium silicate clays, for example, attapulgite, palygorskite and sepiolite. The support can be premade by any method known in the art.

The surface area of the finished sulfur sorbent is in large part due to the support chosen. It is believed that the active sulfur sorbents of this invention can have nitrogen surface areas in the range of between 20 and 300 $m^2/g$.

The metal components of this sulfur sorbent are Group IA or Group IIA metal containing compounds. The preferred metal components are sodium, potassium, calcium, and barium. The metal components are not in general present as the reduced metal. Instead, they are usually present in the form of a salt, oxide, hydroxide, nitrate, carbonate or other compound. It is the metal in the compound, in any form, that is the metal component of the sorbent of this invention. The sulfur sorbents of this invention can be made by impregnation of a preformed refractory inorganic oxide support with a metal component, or by comulling the metal component with an inorganic oxide support. It is preferred that the sulfur sorbent contain from 5 to about 40, and most preferably from 7 to about 15 wt % of the metal.

Preferred metal compounds include sodium chloride, sodium nitrate, sodium hydroxide, sodium carbonate, sodium oxalate, potassium chloride, potassium nitrate, potassium carbonate, potassium oxalate, potassium hydroxide, barium chloride, barium nitrate, barium carbonate, barium oxalate, barium hydroxide, calcium chloride, calcium nitrate, calcium carbonate, calcium oxalate, calcium hydroxide, and the like.

A preformed inorganic support can be impregnated with Group IA or Group IIA metals by standard techniques. It may be necessary to impregnate the support several times to achieve the desired amount of metal component on the inorganic support. Various metal compounds can be dissolved to form aqueous solutions useful for this impregnation. The preferred compounds for impregnation are the more soluble compounds. To be useful for impregnation, a compound should have a solubility of at least 0.1 mole per liter of water.

Another method of making the sulfur sorbents useful in reactor 21 is by mulling the powdered inorganic support material, which can be prepeptized or mixed in the presence of a peptizing agent, together with a compound containing a Group IA or Group IIA metal. Preferred peptizing agents are mineral acids, such as nitric acid. For example, peptized alumina powder could be mixed with a metal component, such as potassium carbonate. The resulting mass is then shaped, extruded, dried and calcined to form the final sulfur sorbent.

The choice of the appropriate compound to use during fabrication of the sulfur sorbent is primarily dictated by the solubility of the salt. For example, impregnation, very soluble salts are desired, such as nitrates, but in mulling, relatively insoluble salts, such as carbonates are preferred.

In a most preferred embodiment of the present invention, the process generally involves the use of a potassium containing sulfur sorbent which is prepared using potassium not containing nitrate or other nitrogen containing compounds. Preferably, it involves the use of a sulfur sorbent made by impregnating alumina extrudate with potassium carbonate. When this aspect of the invention is employed, particularly beneficial results can be obtained. That is, the unwanted generation of water and ammonia, which can be harmful, particularly to certain catalysts such as zeolite-type catalysts, can be avoided.

Such a potassium containing sulfur sorbent removes the $H_2S$ from the process stream by reaction according, for example, to the following mechanisms:

$$2KOH+H_2S \rightarrow K_2S+2H_2O \quad (1);$$

and $$K_2O+H_2S \rightarrow K_2S+H_2O \quad (2).$$

The equilibrium is particularly good for potassium such that $H_2S$ may be quantitatively removed from a process stream of hydrocarbon and $H_2$, especially at a temperature of 250° to 500° C.

The most favorable equilibrium is obtained if water in the system is maintained at low levels (e.g., <20 ppm). This can be accomplished, for example, by using feed and recycle driers to minimize introduction of water into the system.

Although sulfur sorbents made by impregnation of alumina with potassium nitrate work very well for sulfur removal, even after calcining at 480°–510° C., such sorbents will typically contain about 2.0 weight percent nitrogen. The nitrogen is then presumably reduced by reaction with $H_2$ during the plant startup to generate ammonia and $H_2O$. Ammonia and $H_2O$ have been found to be harmful to zeolite type catalysts during operation For example it is generally believed that high levels of water accelerate catalyst fouling.

Therefore, this aspect of the invention involves a potassium sulfur sorbent made by impregnating, preferably alumina, with a solution containing a potassium compound, which does not contain nitrate or other nitrogen containing compounds, preferably potassium carbonate. Nitrogen-free potassium compounds such as potassium carbonate are sufficiently soluble in water (e.g., 10 to 105 gms/100 cc) to make sorbents by a simple impregnation method. The mount of the potassium compound used is calculated to make the sorbent with a desired potassium content on the calcined sorbent (e.g., 5–40 weight percent). When the sorbent is dried and calcined and carbonate decomposes according to the mechanism:

$$K_2CO_3 \rightarrow K_2O+CO \ (300°–510° \text{ C.})$$

Any small amount of carbonate remaining in the sorbent can be reduced with $H_2$ in the plant startup according to the mechanism:

$$K_2CO_3+H_2 \rightarrow {}_2KOH+CO \ (300°–425° \text{ C.})$$

without evolving water. While carbon monoxide also could be harmful to a platinum containing catalyst, e.g., a Zeolite-type catalyst, carbon monoxide gas can be easily swept out of the system using normal purging procedures, possibly before loading the platinum zeolite catalyst.

Although potassium carbonate is preferred, other non-nitrogen containing potassium compounds are likely candidates for making the nitrogen-free potassium containing sorbent. In selecting such a compound the pertinent considerations should be its availability, solubility in water, temperature of decomposition during calcination, generation of no harmful residue during startup or operation and reasonable cost. Other suitable potassium compounds include potassium chloride, bromide, acetate formate, bicarbonate, oxalate, phosphate, etc. Of course, potassium compounds which contain sulfur should not be used because of the necessity to exclude sulfur compounds from the overall reactor system. This would make compounds such as potassium sulfate, sulfite, etc. unacceptable.

Accordingly, once the hydrotreated naphtha feedstock has been processed in accordance with the sulfur removal system of the present invention, and optionally submitted to additional processing such as that described above with regard to reactors 20 and 21 of the FIGURE, it can then be passed on to reforming under conventional reforming conditions for the production of aromatics. The reforming catalyst used in the reforming operation for the production of aromatics is preferably a large-pore zeolite charged with one or more dehydrogenating constituents, e.g., a Group VIII metal such as platinum. The term "large-pore zeolite" is defined as a zeolite having an effective pore diameter of 6 to 15 Angstroms.

Among the large-pore crystalline zeolites which have been found to be useful in the practice of the present invention, type L zeolite, zeolite X, zeolite Y and faujasite have been found to be the most effective and have apparent pore sizes on the order of 7 to 9 Angstroms.

The composition of type L zeolite, expressed in terms of mole ratios of oxides, may be presented by the following formula:

$$(0.9–1.3)M_{2/n}O:Al_2O_3(5.2–6.9)SiO_2:yH_2O$$

In the above formula M represents a cation, n represents the valence of M, and y may be any value from 0 to about 9.

Zeolite L, its X-ray diffraction pattern, its properties, and method for its preparation are described in detail in, for example, U.S. Pat. No. 3,216,789, the contents of which is hereby incorporated by reference. The actual formula may vary without changing the crystalline structure for example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

In the above formula, x is a value greater than 3 and up to about 6. Y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007, the contents of which is hereby incorporated by reference.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2$$

In the above formula, M represents a metal, particularly alkali and alkaline earth metals, n is the valence of M, and Y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244, the contents of which is hereby incorporated by reference.

It is preferred that the more sulfur sensitive reforming catalyst used in this invention is a type L zeolite charged with one or more dehydrogenating constituents.

The conditions of the reforming operation are those generally employed in the reforming industry to produce aromatics from aliphatic hydrocarbons. The conditions can be varied to focus upon the production of a particular aromatic, e.g., benzene. The choice of catalyst and conditions for such a focused production is also well known to the art.

The invention will be further illustrated in greater detail by the following specific example. It is understood that this example is given by way of illustration and is not meant to limit the disclosure of the claims to follow. All percentages in the example, and elsewhere in the specification, are by weight unless otherwise specified.

EXAMPLE

This Example demonstrates comparatively the surprising advantage of the present invention. A hydrotreated naphtha feedstock containing about 8 ppm sulfur was contacted with massive nickel catalyst at consistent conditions of 4 LHSV and 200 psig under seven different sequences of operating conditions. The differences in the various conditions were primarily of hydrogen pressure and temperature. The Table below sets forth the conditions and results for each of the seven sequences of operating conditions used in the experimental run.

TABLE

| | Operation Sequence No. | | | | | | |
|---|---|---|---|---|---|---|---|
| Condition | 1 | 2 | 3 | 4 | 5 | 6 | 7 |
| Reactor Temp. | 350° F. | 400° F. | 400° F. | 350° F. | 350° F. | 350° F. | 400° F. |
| $H_2$ Flow Rate, CC/min | 0 | 0 | 2 | 2 | 0 | 2 | 2 |
| Av. Feed Sulfur, ppm | 8.4 | 8.3 | 7.8 | 8.1 | 8.5 | 7.4 | 6.9 |
| Avg. Prod Sulfur, ppm | 8.2 | 0.05 | <0.026 | <0.026 | >6.5 | 0.078 | 0.061 |
| Sulfur Removal | 2.4% | 99.4% | >99.7% | >99.7% | <23% | 99%* | 99.1%* |
| Hours at Condition | 300 | 100 | 680 | 485 | 330 | 640 | |

*Catalyst was nearing load maximum of sulfur.

From the foregoing Table, it can be seen that only when hydrogen is present is optimum sulfur control achieved.

While the invention has been described with preferred embodiments, it is to be understood that variations and modifications may be resorted to as will be apparent to one skilled in the art. Such variations and modifications are to be considered within the purview and scope of the claims appended hereto.

What is claimed is:

1. A method for removing sulfur from a hydrotreated naphtha feedsock containing sulfur compounds, comprising contacting the naphtha feedstock with massive nickel catalyst in the presence of hydrogen, with the amount of hydrogen being such that the molar ratio of hydrogen to hydrocarbon is about 1 and the temperature of the contacting step is in the range of from about 350° to 400° F.

2. The method of claim 1, wherein the massive nickel catalyst is comprised of about 55 weight % nickel on an amorphous silica bound with alumina.

3. The method of claim 1, wherein the resulting feedstock after the contacting contains less than 10 ppb sulfur.

4. The method of claim 1, wherein the resulting feedstock after the contacting step contains less than 5 ppb sulfur.

5. The method of claim 1, which further comprises subsequently passing the contacted naphtha feedstock to a feed dryer comprised of molecular sieves.

6. The method of claim 1, which further comprises subsequently passing the contacted naphtha feedstock to a sulfur conversion catalyst comprising a Group VIII metal, with which the feedstock is contacted in the presence of hydrogen, and then to a solid sulfur sorbent containing a Group IA or IIA metal.

7. The method of claim 6, wherein the sulfur conversion catalyst comprises platinum as a Group VIII metal.

8. The method of claim 6, wherein the sulfur conversion catalyst comprises platinum on alumina.

9. The method of claim 6, wherein the sulfur sorbent comprises potassium.

10. The method of claim 6, wherein the contacting with a sulfur conversion catalyst is conducted under conditions of about 2–10 LHSV; a mole ratio of hydrogen to hydrocarbon ranging from 0.5:1 to 6:1; a temperature from about 250° C.

to about 425° C. and a pressure of from about 50 to 300 psig; and, the contacting with the sulfur sorbent is conducted under conditions of about 2 to 10 LHSV; a pressure of from about 50 to 300 psig and a temperature in the range of from about 250° C. to about 450° C.

11. The method of claim 1, wherein the sulfur sorbent is prepared by impregnating a support with a non-nitrogen containing potassium compound.

12. The method of claim 11, wherein potassium carbonate is used to impregnate the support.

13. A method for removing sulfur from a hydrotreated naphtha feedstock containing sulfur compounds, comprising contacting the naphtha feedstock in a temperature range of from about 350° F. to about 400° F. over a massive nickel catalyst in the presence of hydrogen, with the amount of hydrogen being such that the molar ratio of hydrogen to hydrocarbon is about 1.

14. The method of claim 13, wherein the amount of hydrogen used is such as to provide a molar ratio of hydrogen to hydrocarbon of about 1, and the temperature used in the contacting step is about 400° F.

15. The method of claim 13, wherein the space velocity is in the range of from 1–10 LHSV.

16. A method of reforming a naphtha feedstock which comprises hydrotreating the naphtha feed;

contacting the naphtha feedstock with massive nickel catalyst in the presence of hydrogen such that the molar ratio of hydrogen to hydrocarbon is about 1 and the contacting temperature is in the range of from about 350° to 400° F.; and forwarding the resulting feed to a reforming operation, whereby the resulting feed is subjected to reforming.

17. The method of claim 16, wherein the method further comprises contacting the naphtha feed resulting from the contacting step with the massive nickel with a sulfur conversion catalyst comprising a Group VIII metal in the presence of hydrogen in order to produce an effluent;

contacting the effluent from the sulfur conversion contacting step contacting with a solid sulfur sorbent comprising a Group IA or IIA metal; and then forwarding the resulting feed to a reforming operation.

18. The method of claim 16, wherein the reforming operation utilizes an L zeolite catalyst.

19. The method of claim 16, wherein the reforming operation is comprised of one or more reactors containing a reforming catalyst.

20. The method of claim 16, wherein the reforming operation is operated under conditions to enhance aromatics production.

21. The method of claim 16, wherein the method further comprises recovering an aromatic containing product stream.

22. The method of claim 16, wherein the method further comprises recovering a product stream rich in benzene.

23. The method of claim 16, wherein the method further comprises recovering a product stream rich in benzene, toluene and xylene.

* * * * *